US006569284B1

(12) United States Patent
Yin et al.

(10) Patent No.: US 6,569,284 B1
(45) Date of Patent: May 27, 2003

(54) ELEMENTAL-CHLORINE-FREE BLEACHING PROCESS HAVING AN INITIAL $E_O$ OR $E_{OP}$ STAGE

(75) Inventors: Caifang Yin, Monroe, NY (US); Jasper H. Field, Goshen, NY (US)

(73) Assignee: International Paper Company, Purchase, NY (US)

( * ) Notice: Subject to any disclaimer, the term of this patent is extended or adjusted under 35 U.S.C. 154(b) by 929 days.

(21) Appl. No.: 09/108,541

(22) Filed: Jul. 1, 1998

Related U.S. Application Data

(63) Continuation of application No. 08/719,077, filed on Sep. 24, 1996, now abandoned.

(51) Int. Cl.[7] ..... D21C 9/14; D21C 9/147; D21C 9/16; D21C 11/00

(52) U.S. Cl. ..... 162/29; 162/37; 162/65; 162/78; 162/88; 162/89

(58) Field of Search ..... 162/65, 78, 88, 162/89, 37, 38, 39, 40, 29, 67, 30.1, 30.11

(56) References Cited

U.S. PATENT DOCUMENTS

| | | | | |
|---|---|---|---|---|
| 3,382,149 A | | 5/1968 | Hoh | 162/78 |
| 3,691,008 A | | 9/1972 | Worster et al. | 162/25 |
| 3,719,552 A | * | 3/1973 | Farley et al. | 162/65 |

(List continued on next page.)

FOREIGN PATENT DOCUMENTS

| | | | | |
|---|---|---|---|---|
| EP | 222 674 | * | 5/1987 | 162/89 |
| WO | WO 94/13591 | | 6/1994 | |

OTHER PUBLICATIONS

Li et al, "The effects of alkaline leaching on pulp bleachability and physical properties", TAPPI J., vol. 76, No. 12, pp. 159–166, Dec. 1993.*

Ibister, et al; "The closed cycle concept kraft mill at Great Lakes an advanced status report", p. T174–180, Jun. 1979.*

Carmichael et al, "Short–sequence bleaching with hydrogen peroxide", TAPPI, Nov. 1986.*

"Zero pollution from a paper pulp process", *Business Week,* p. 48j, Dec. 22, 1975.

(List continued on next page.)

*Primary Examiner*—Steve Alvo
(74) *Attorney, Agent, or Firm*—Luedeka, Neely & Graham, PC

(57) ABSTRACT

The specification discloses an improved bleaching sequence which provides significant reduction in filtrate volumes and amounts of absorbable organic halide (AOX), color, and chemical oxygen demand (COD) in the effluent. These reductions are achieved without adversely affecting the brightness and viscosity properties of the bleached pulp and without a high capital cost and operating cost penalty or impact on existing mill processes. The bleaching sequence according to the invention for reducing filtrate volumes is an $E_OD_1E_{OP}D_2$ or $E_{OP}D_1E_{OP}D_2$ bleaching sequence wherein substantially all of the filtrates from the later bleaching stages are recycled to earlier bleaching stages and eventually treated in the initial $E_O$ or $E_{OP}$ stage prior to discharge from the plant. An advantage of the invention is that pulp having a Kappa number of greater than about 25 for softwood and greater than about 15 for hardwood may be fed to the bleaching process while still providing a bleached pulp having sufficient brightness, viscosity characteristics and good pulp yield.

24 Claims, 2 Drawing Sheets

U.S. PATENT DOCUMENTS

| | | | | | |
|---|---|---|---|---|---|
| 3,725,194 | A | | 4/1973 | Smith et al. | 162/65 |
| 3,843,473 | A | * | 10/1974 | Samuelson et al. | 162/65 |
| 3,961,976 | A | | 6/1976 | Karlsson | 106/186 |
| 4,274,912 | A | * | 6/1981 | Carles et al. | 162/65 |
| 5,120,448 | A | | 6/1992 | Dorica et al. | 210/724 |
| 5,149,442 | A | | 9/1992 | Nyström et al. | 210/724 |
| 5,164,043 | A | | 11/1992 | Griggs et al. | 162/57 |
| 5,188,708 | A | | 2/1993 | Griggs et al. | 162/40 |
| 5,211,811 | A | | 5/1993 | Griggs et al. | 162/40 |
| 5,853,535 | A | * | 12/1998 | Maples et al. | 162/65 |

OTHER PUBLICATIONS

W.H. Rapson, "Pulp & Paper Technology: The Closed–Cycle Bleached Kraft Pulp Mill", *CEP,* pp. 68–71, vol. 73, No. 6, Jun. 1976.

D.W. Reeve, "The effluent–free bleached kraft pulp mill", *Pulp & Paper Canada,* vol. 77, No. 8, pp. T136–T143, Aug., 1976.

Li et al., "The effects of alkaline leaching on pulp bleachability and physical properties," TAPPI J. vol. 76, No. 2, pp. 159–166.

Carmichael et al. "Short Sequence Bleaching With Hydrogen Peroxide," TAPPI J. Nov. 1986, pp. 90–94.

J.A. Isbister et al., "The closed cycle concept kraft mill at Great Lakes—an advanced status report", *Pulp & Paper Canada,* vol. 80, No. 6, pp. T174–T180, Jun., 1979.

* cited by examiner

ELEMENTAL-CHLORINE-FREE BLEACHING PROCESS HAVING AN INITIAL $E_O$ OR $E_{OP}$ STAGE

This application is a continuation of application Ser. No. 08/719,077 filed Sep. 24, 1996, now abandoned.

FIELD OF THE INVENTION

The present invention relates to an improved process for bleaching pulp in an elemental-chlorine-free (ECF) bleaching process which reduces the volume of bleach plant effluent as well as the amount of adsorbable organic halides (AOX), chemical oxygen demand (COD) and color content of the effluent.

BACKGROUND OF THE INVENTION

The process of bleaching pulp for use in papermaking may be performed with halogen-containing or non-halogen-containing bleaching agents. Currently, the industry has been moving away from halogen-containing agents due to public perception and environmental concerns over chlorinated organics and dioxins believed to be by-products of conventional halogen-based bleach processes. However, attempts to reduce the formation of organic halogen compounds during the bleaching process by use of peroxide and/or non-halogen oxygen-containing compounds often fall short of providing an economical pulp with sufficient brightness, viscosity and yield.

Many of the recently proposed techniques for reducing discharge of AOX compounds adversely affect the quality of the bleached product and economics of bleach plant operations. For example, extended delignification, totally chlorine-free (TCF) and totally effluent-free (TEF) bleaching processes result in an economic penalty and loss of product quality. The TCF bleaching process is capital-intensive and requires the addition of pressurized oxygen and/or ozone stages. Extended delignification to a Kappa No. of 15–20 typically needed for successful TCF bleaching causes excessive strength and yield loss leading to inferior product quality and higher operating costs. Extended delignification also exerts an additional load on the pulp mill chemical recovery system and caustic plant operations which have a negative impact on mill production.

Much recent work has focused on use of chlorine dioxide as a bleach agent as opposed to elemental chlorine due to the fact that chlorine dioxide, although generally less effective than elemental chlorine, offers the prospect of reduced chlorinated organics in the effluent with acceptable pulp properties. However, continued pressure for development of lowered effluent discharge has raised questions about whether use of chlorine dioxide alone represents a long-term solution to the problem.

Other techniques require the expenditure of significant capital for plant modifications in order to treat the effluent. There remains, therefore, a need for a cost effective means to substantially reduce the pulp bleaching filtrate volume as well as lowering the amount of AOX, COD and color in the effluent from the bleach plant while at the same time maintaining high brightness, viscosity and yield values of the bleached pulp.

Accordingly, it is an object of the present invention to provide a process which reduces the amount of chlorinated organics and other undesirable components in the effluent from a pulp bleaching process.

It is another object of the invention to provide a halogen-based bleaching process wherein the efficiency of the bleaching process is maintained without adversely affecting the pulp brightness, viscosity or yield while achieving significant reductions in the AOX, COD and color of a bleach plant effluent.

A further object of the invention is to provide a method for reducing the amount of halogen-based bleach agents needed in a pulp bleaching process to obtain a target brightness, viscosity and yield for the bleached pulp.

Another object of the invention is to reduce the volume of filtrate from the bleaching process which must be treated or recycled.

SUMMARY OF THE INVENTION

With regard to the above and other objects, the present invention provides a method for treating a pulp containing lignocellulosic fibers with chlorine dioxide wherein the adsorbable organic halide content of the bleached pulp effluent is significantly reduced. The method comprises bleaching the pulp in a $E_OD_1E_{OP}D_2$ or $E_{OP}D_1E_{OP}D_2$ bleaching sequence wherein pulp from at least one of the $D_1$ or $D_2$ stages is washed after the stage to produce a $D_0$ or D filtrate and the $D_0$ or D filtrate is recycled, mixed and treated with the pulp entering the initial $E_O$ or $E_{OP}$ stage. In the bleaching sequence, "E" represents an extraction stage reinforced with oxygen and/or peroxide ($E_O$ or $E_{OP}$), $D_1$ represents an initial chlorine dioxide bleaching stage and $D_2$ chlorine dioxide final bleaching stage. It is to be understood that the terminology "extraction stage" is not used herein in with regard to the initial $E_O$ or initial $E_{OP}$ stage according to the meaning often associated with the same; i.e., a treatment stage employing caustic following an acidic chlorination stage. Rather, as used herein regarding the initial $E_O$ or initial $E_{OP}$ stage, the word "extraction" refers to a stage in which the pulp is treated substantially according to the conditions of what is conventionally known as an extraction stage, i.e., treatment of the incoming pulp slurry with caustic (in this case supplemented with either oxygen or oxygen and peroxide) resulting in an alkaline pulp mixture, irrespective of whether the stage immediately follows a chlorine-containing bleaching stage.

Quite surprisingly, it has been found that essentially simultaneous treatment of recycled filtrate streams and delignification of the pulp may be obtained in an oxygen or oxygen and peroxide-assisted first extraction stage without adversely affecting the viscosity or brightness of the bleached pulp. Furthermore, the benefits of the present invention may be obtained with a significant reduction in the amount of organic halide compounds in the pulp and/or effluent produced by the bleaching process. These results are truly remarkable since they do not require significant changes in the bleaching process and thus may be implemented without substantially increasing the complexity or operating costs of the process and without the need for substantial capital expenditures.

Unlike the extended delignification processes, the effluent from first extraction stage according to the invention is not recycled to a recovery boiler for treatment, hence the use of filtrate from a $D_1$ or $D_2$ stage washer can be used to adjust the consistency of the pulp in the initial $E_O$ or $E_{OP}$ stage. Furthermore, much lower operating pressures are used in the initial $E_O$ or $E_{OP}$ stage according to the invention thereby lowering capital equipment costs.

In another aspect the invention provides a process for treating a pulp containing lignocellulosic fibers. The process comprises providing a lignocellulosic pulp at a consistency in the range of from about 20% to about 40% and at a pH in the range of from about 3 to about 11 and bleaching the pulp with an $E_OD_1E_{OP}D_2$ or $E_{OP}D_1E_{OP}D_2$ bleaching sequence wherein the pulp from at least one of the $D_0$ or D stages is washed after the stage to produce a $D_1$ or $D_2$ filtrate and the $D_1$ or $D_2$ filtrate is recycled, mixed and treated with the pulp entering the initial $E_O$ or $E_{OP}$ stage.

In a preferred embodiment, the invention provides a process for treating a pulp containing lignocellulosic fibers with elemental chlorine-free bleaching agents in an $E_OD_1E_{OP}D_2$ or $E_{OP}D_1E_{OP}D_2$ bleaching sequence wherein the pulp has an initial Kappa number of greater than about 25 for softwood and greater than about 15 for hardwood and a consistency within the range of from about 25 to about 30%. Essentially simultaneous treatment of the filtrate from the first $D_1$ stage may be obtained by recycling the filtrate from the first $D_1$ stage of the bleaching sequence to the initial $E_O$ or $E_{OP}$ stage for use in adjusting the pulp consistency to a consistency in the range of 5 to 10% and/or as a portion of the wash liquid for the pulp washer after the first alkaline extraction stage.

One significant advantage of the bleaching process according to the invention is that it requires essentially no incremental chemical recovery equipment expenditures or additional caustic capacity, yet should meet or exceed the proposed EPA limits of nondetectable dioxins and polychlorophenolics and 0.156 kg/ADT of AOX in the bleach plant effluent. Both the EPA's best available technology (BAT) and the bleach filtrate recycle process, such as the one under development by Champion International, using an $ODE_{OP}D$ bleaching sequence may meet the proposed EPA limits, but require high capital investment and additional chemical recovery and caustic plant capacity to accommodate the additional solids produced by oxygen delignification. Furthermore, the $ODE_{OP}D$ process does not recycle D stage filtrate to the pulp entering the oxygen delignification stage.

A further significant advantage of the bleaching process according to the invention is that it achieves reduced AOX, color and COD with significantly reduced filtrate volumes. Hence, the amount of effluent which needs to be treated in the plant effluent treatment system prior to discharge of treated water from the plant is significantly reduced.

BRIEF DESCRIPTION OF THE DRAWINGS

The above and other aspects and advantages of the invention will now be further described in conjunction with the accompanying drawings in which.

DETAILED DESCRIPTION OF THE INVENTION

A key feature of the present invention is the use of an initial alkaline extraction stage assisted by oxygen or oxygen and peroxide (an $E_O$ or $E_{OP}$ stage) before the first chlorine dioxide stage with mixing of filtrate from later chlorine dioxide stages with pulp entering the $E_O$ or $E_{OP}$ stage whereby substantial delignification of the pulp and simultaneous reduction in filtrate AOX, COD and color are obtained without the need for additional filtrate treatment facilities and treatment chemicals. Accordingly, a bleaching sequence designated by $E_OD_1E_{OP}D_2$ or $E_{OP}D_1E_{OP}D_2$ is used to bleach the pulp.

In the initial $E_O$ or $E_{OP}$ extraction stage, oxygen or oxygen and peroxide in an alkaline environment at a temperature in the range of from about 70° to about 90° C. are used to achieve the desired level of delignification and further reduction of filtrate emissions of AOX, COD and color prior to the first chlorine dioxide ($D_1$) stage of the bleaching process. Because the pulp is substantially delignified prior to the first $D_1$ stage less chlorine dioxide is needed in the later bleaching stages to obtain the desired pulp brightness. Furthermore, recycling the filtrates from later bleaching stages to earlier bleaching stages of the bleach sequence and eventually to the initial $E_O$ or $E_{OP}$ stage reduces filtrate volume and emissions of AOX, COD and color without significantly affecting the properties of the pulp.

Accordingly, an important aspect of the invention is the combination of countercurrent filtrate recycling from the later stages of the bleaching process along with use of filtrate from the initial $D_1$ stage washer to adjust the consistency of the pulp in the initial $E_O$ or $E_{OP}$ stage and/or to wash the pulp on a pulp washer subsequent to the initial $E_O$ or $E_{OP}$ stage. The filtrates from later $D_2$ and $E_{OP}$ stages may be substantially completely recycled, mixed together and used for pulp washing and/or as make-up water for adjusting the consistency of the pulp in earlier bleaching stages.

Use of a bleaching process according to the invention has been found to reduce the initial content of the AOX in the filtrate leaving the plant by about 90% by weight, reduce color by about 50% by weight, reduce COD by about 75% by weight, and significantly reduce filtrate volume from about 10,000 gallons per ton for conventional bleach plants down to about 5,000 gallons per ton of pulp bleached.

Figure 1:
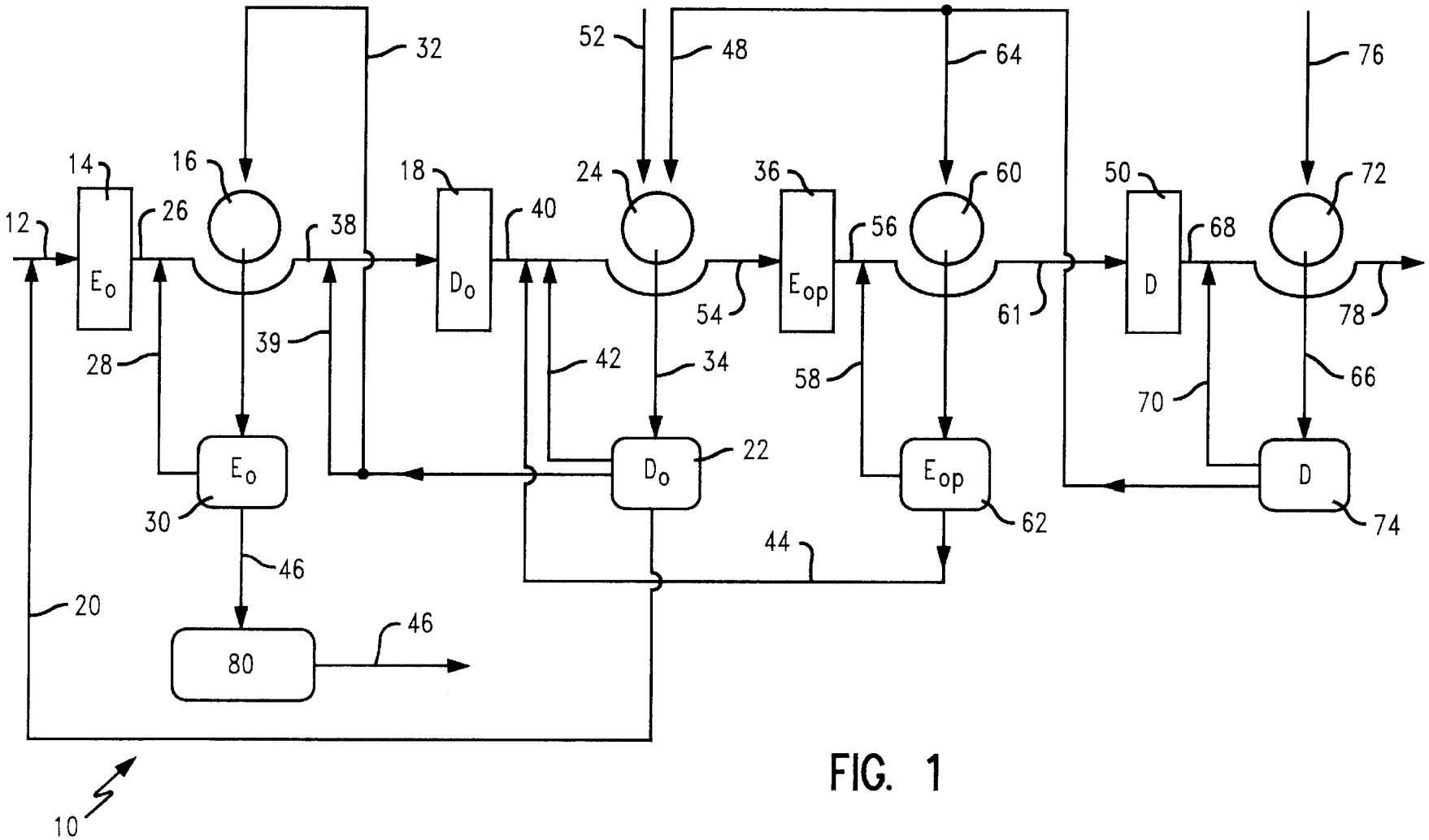
FIG. 1 is a block flow diagram of one embodiment of a bleaching process according to the invention.

Further aspects of the invention may be understood by referring to the drawings. FIG. 1 is a block flow diagram illustrating steps in a bleaching process system 10 according to one embodiment of the invention. The incoming pulp is of the type of brown stock produced by the kraft cooking process destined for use in bleached form in various products such as white paper, paperboard and the like. This type of pulp is often referred to as low yield kraft pulp in which an appreciable amount of lignin has been removed preparatory to bleaching, and is to be contrasted with a high yield kraft pulp which is not bleached and which contains a significant amount of lignin (usually with Kappa numbers above about 60). Accordingly, the Kappa number of the incoming pulp is greater than about 25 for softwood pulp and greater than about 15 for hardwood pulp and the bleached pulp has a GE brightness of greater than about 85%.

In the illustrated process, brown stock 12 having a consistency of about 30 wt. % is fed in series to an initial extraction tower 14 for the $E_O$ or $E_{OP}$ stage, an extraction tower washer 16 and a bleach tower 18 for a first chlorine dioxide bleach stage $D_1$. Recycle filtrate 20 is pumped by filtrate pump 22 from the $D_1$ stage washer 24 so that it mixes with the brown stock 12 to adjust the consistency of the brown stock down to from about 5 to about 10 wt. % in the first extraction tower 14. Accordingly, $D_1$ filtrate having a volume of from about three to about six times the volume of the incoming pulp may be mixed with the incoming pulp to produce a pulp having a consistency of from about 5 to about 10 wt. % prior to the first $E_O$ or $E_{OP}$ stage.

Because the $D_1$ filtrate typically has a pH in the range of from about 2 to about 4, additional NaOH may be added to the initial $E_O$ or $E_{OP}$ stage to adjust the pH to within a range of from about 9.0 to about 11.0. Hence, the first $E_O$ or $E_{OP}$ stage may require from about 40 to about 60 pounds of NaOH per ton of pulp (on a dry weight basis of fibers) in order to delignify the pulp and neutralize the acid in the $D_1$ filtrate, and still maintain a pH in the $E_O$ or $E_{OP}$ stage above about 9.0.

The $E_O$ or $E_{OP}$ stage process is typically conducted for about 60 minutes. During that period of time, the oxygen pressure decreases from a pressure of about 50 psig to about 0 psig. When the delignification process is reinforced with peroxide, the amount of peroxide used ranges from about 0.2 to about 2 wt. % based on the oven dry weight of pulp and preferably about 0.6 wt %.

Treated pulp 26 from the extraction tower 14 having a consistency of about 5 to about 10 wt. % based on dry weight of pulp is conducted to a washer 16 after diluting the treated pulp 26 from the $E_O$ or $E_{OP}$ stage to a consistency of about 1 wt. % with washer filtrate 28 pumped by washer filtrate pump 30 from extraction tower washer 16. In this first embodiment, all or a portion of wash liquid 32 used to wash the treated pulp 26 in washer 16 is obtained from washer filtrate pump 22 which collects and transfers the wash liquid 34 from washer 24 subsequent to the $D_1$ stage 18.

The pulp is concentrated to a consistency of from about 10 to about 15 wt. % by the drum filter of washer 16 and the washed pulp 38 is mixed with recycle filtrate 39 from washer filtrate pump 22 to provide a pulp having a consistency of about 3 to about 8 wt. % which is further delignified and partially bleached in the first $D_1$ stage. The consistency of pulp 38 is adjusted to the desired range by adding filtrate from $D_1$ washer 24 in an amount which is about 5 to about 10% of the weight of pulp entering washer 16. The pH of the pulp in the $D_1$ stage 18 is lowered to about 2 to about 5 by the use of acidic chlorine dioxide in the $D_1$ stage. The $D_1$ stage is conducted for about 60 minutes at a temperature ranging from about 40° C. to about 70° C. and with a chlorine factor in the range of from about 0.05 to about 0.35.

The partially delignified and bleached pulp 40 is mixed with filtrate 42 pumped by filtrate pump 22 and filtrate 44 from a pulp washer 60 for a subsequent alkaline extraction stage $E_{OP}$ to provide a pulp having a consistency of about 1%. Combination of the $D_1$ and $E_{OP}$ filtrates (42 and 44) with the partially delignified pulp 40 results in a decrease in the AOX, COD and color of the recycled filtrate streams and ultimately the effluent filtrate stream 46 leaving the bleach plant. A portion of the wash water used on washer 24 is recycled filtrate 48 from a later chlorine dioxide stage $D_2$. Fresh water 52 may also be used to wash the delignified and bleached pulp 40 on washer 24.

The consistency of the pulp 54 exiting the drum filter of washer 24 is again in the range of from about 10 to about 15% and the pH is adjusted to about 10 to about 11 by the addition of from about 30 to about 50 pounds of NaOH per ton of pulp.

Washed pulp 54 is treated in $E_{OP}$ stage 36, and after treatment, the treated pulp 56 is mixed with recycled filtrate 58 from washer 60 which is pumped by filtrate pump 62 to the treated pulp 56 in order to adjust tile consistency of pulp 56 to about 1%. The $E_{OP}$ stage 36 is also conducted for about 60 minutes at a temperature of about 70° C. to about 90° C. A similar amount of peroxide and oxygen are used in the $E_{OP}$ stage 36 as in the initial $E_{OP}$ stage.

The wash water 64 for washer 60 is obtained from tile washer filtrate 66 from the subsequent chlorine dioxide stage $D_2$ is about 10 weight % of the weight of pulp being washed. The washed pulp 61 from the filter drum of washer 60 typically has a consistency of from about 8 to about 12% and is fed to the $D_2$ stage 50 for final bleaching. The pH of the $D_2$ stage 50 is adjusted to from about 2 to about 5 by the use of acidic chlorine dioxide, and the $D_2$ stage is conducted for about 3 hours at a temperature in the range of from about 40° C. to about 70° C. and with a chlorine factor of from about 0.05 to about 0.35.

Following the $D_2$ stage, the bleached pulp 68, at a consistency of about 10 wt. % is diluted to a consistency of about 1% by filtrate 70 pumped from washer 72 by filtrate pump 74. Fresh wash water 76 in an amount which is about 10 wt. % of the pulp being washed preferably enters the system on washer 72 for washing the pulp after the $D_2$ stage thereby providing a final bleached pulp stream 78 having a GE brightness of about 85 or higher and a viscosity of about 14 centipoise or higher. The consistency of the pulp exiting the bleaching system typically ranges from about 10 to about 15 wt. %.

Thus, according to the process illustrated by FIG. 1, fresh water enters the system 10 only in two locations, washer 24 and washer 72, and bleach plant effluent filtrate stream 46 from washer 16 is collected in effluent collection tank 80 where it is discharged from the bleach plant. In this connection, the consistency of pulp leaving in stream 78 may be about 10 wt. % while the consistency of pulp entering in stream 12 may be from about 25 to about 30 wt. % based on the dry weight of pulp. Accordingly, the amount of fresh make-up water entering at 76 and 52 is balanced with the amount of filtrate leaving at 46 taking into account the change in beginning and ending consistency and other factors which affect the net loss or gain in the water content of pulp as it traverses the system 10.

System 10 therefore represents a process having an initial extraction stage and fully countercurrent recycling of the filtrate streams. The filtrate streams recycled to the initial extraction stage 14 provide reduced use of fresh water to obtain a pulp consistency in the desired range while at the same time providing a means for treating the filtrate stream to reduce chlorinated organics in situ in the extraction stage.

Figure 2:
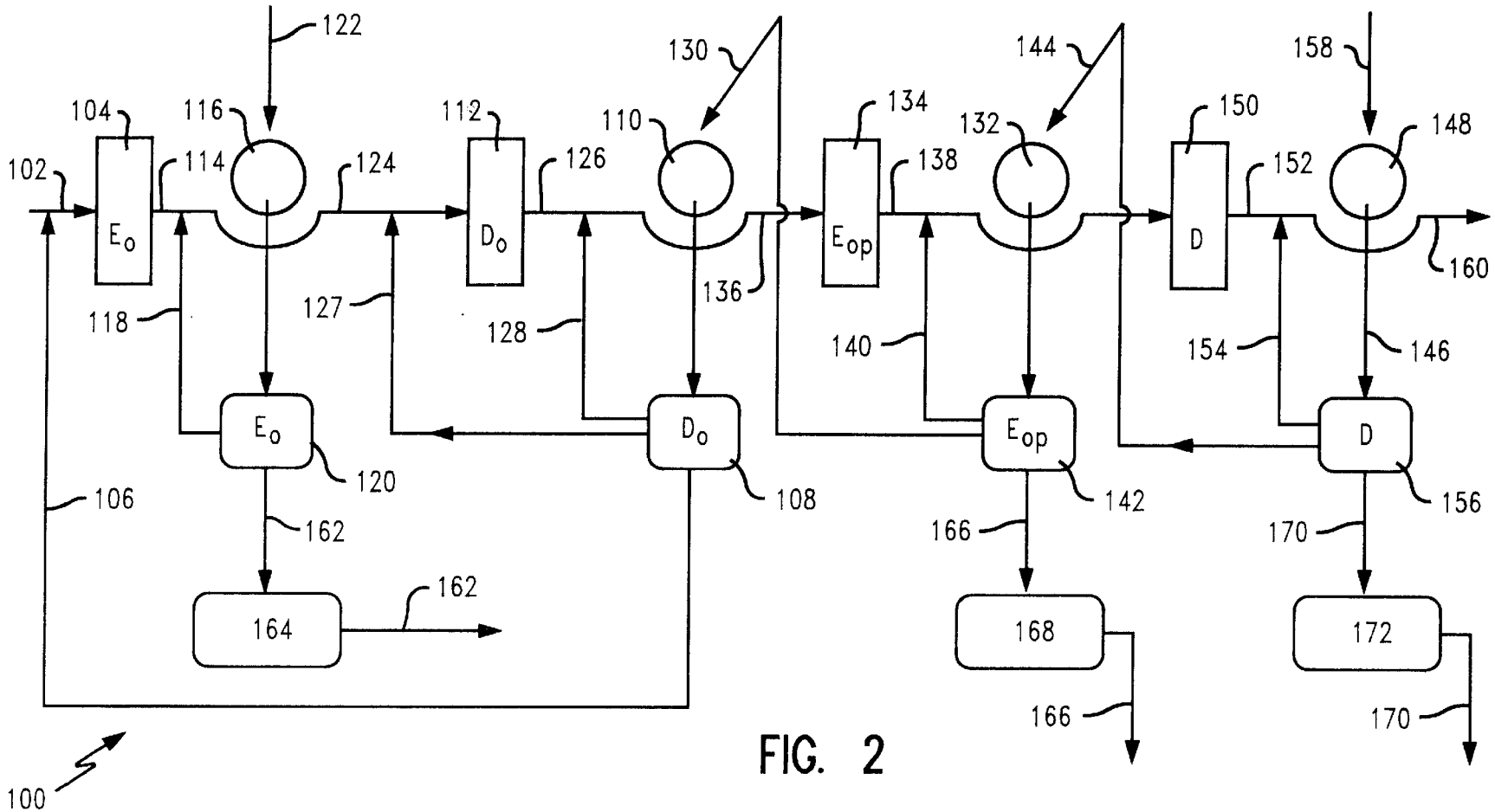
FIG. 2 is a block flow diagram of another embodiment of a bleaching process according to the invention.

An alternative bleaching process 100 according to another embodiment of the invention is illustrated in FIG. 2. In the process, incoming brown stock 102 having a consistency of about 30 wt. % is fed to an initial extraction tower 104 for the $E_O$ or $E_{OP}$ stage. Recycle filtrate 106 is collected from washer 110 subsequent to a first chlorine dioxide bleach ($D_1$) stage. The recycle filtrate 106 is transferred by pump 108 so that it mixes with the incoming brown stock 102 to adjust the consistency of the brown stock entering the $E_O$ or $E_{OP}$ stage to from about 5 to about 10 wt. % based on the dry weight of pulp.

The recycle filtrate 106 from the $D_1$ stage washer used to adjust the consistency of the incoming pulp may be from about two to about six times the weight of the incoming pulp to produce a pulp having the desired consistency of about 5 to about 10 wt. % prior to the first $E_O$ or $E_{OP}$ stage.

Because the $D_1$ filtrate typically has a pH in the range of from about 2 to about 4, additional NaOH is added to the initial $E_O$ or $E_{OP}$ stage to adjust the pH to within the range of from about 9.0 to about 11.0. Hence, the first $E_O$ or $E_{OP}$ stage may require from about 40 to about 60 pounds of NaOH per ton of pulp (on a dry weight basis of fibers) in order to delignify the pulp and neutralize the acid in the $D_1$ filtrate while maintaining a pH in the $E_O$ or $E_{OP}$ stage above about 9.0.

The treated pulp 114 from the extraction tower 104 having a consistency of about 5 to about 10 wt. % is fed to a washer 116 in combination with recycled filtrate 118 from filtrate pump 120 from the washer 116 so that the consistency of the pulp is about 1 wt. %. The wash liquid 122 used to wash the treated pulp 114 is preferably fresh water which enters the system at this point in the process. The amount of water used to wash the pulp is about 5 to about 10 wt. % of the weight of pulp.

The pulp is concentrated to a consistency of from about 10 to about 15 wt. % by the drum filter of washer 116 and then the washed pulp is partially bleached in the $D_1$ stage. The partially bleached pulp 126 is mixed with filtrate 128 from filtrate pump 108. The consistency of the pulp is adjusted to about 3 to about 5 wt. % by adding filtrate from the $D_1$ washer 110 in an amount which is about 5 to about 10% of the weight of pulp entering washer 116. The pH of the pulp in the $D_1$ stage 112 is lowered to about 2 to about 5 by the use of chlorine dioxide in the $D_1$ stage.

After the initial $D_1$ stage, the pulp is diluted again to 1 wt. % consistency using filtrate from washer 110 in an amount which is about one to about two times the weight of pulp entering the washer 110. Filtrate from a subsequent $E_{OP}$ stage is used to wash the pulp on washer 110. The amount of $E_{OP}$ filtrate 130 is about 8 to about 12 wt. % of the pulp being washed.

Washed and delignified pulp 136 from washer 110 and the $D_1$ stage enters alkali extraction stage $E_{OP}$ at a consistency of about 10 to about 12 wt. % and the pH is adjusted to about 10 to about 11 by the addition of from about 30 to about 50 pounds of NaOH per ton of pulp.

After treatment in extraction stage $E_{OP}$, the treated pulp 138 is mixed with recycled filtrate 140 from washer 132 which is pumped by filtrate pump 142 to treated pulp 138 to dilute the treated pulp to a consistency of about 1 wt. % for the washing step. The wash water 144 for washer 132 is obtained as a filtrate 146 from pulp washer 148 after a subsequent chlorine dioxide ($D_2$) stage 150 and is about 10 wt. % of the pulp being washed. The Washed pulp from the filter drum of washer 132 has a consistency of from about 8 to about 12 wt. % and is fed to the $D_2$ stage 150 for final bleaching. The pH of the pulp in the $D_2$ stage 150 is lowered to about 2 to about 5 by the use of chlorine dioxide in the $D_2$ stage.

The bleached pulp 152 at a consistency of about 10 wt. % is combined with filtrate 154 from washer 148 which is pumped to the bleached pulp 152 by filtrate pump 156 to provide a pulp consistency of about 1 wt. %. Fresh wash water 158 also enters the system on washer 148 for washing the pulp after the $D_2$ stage thereby providing a final bleached pulp stream 160 having a GE brightness of about 85 or higher and a viscosity of about 14 centipoise or higher. The consistency of the pulp 160 exiting the bleaching system ranges from about 10 to about 15 wt. %.

Thus, according to the process illustrated by FIG. 2, fresh water enters the system 100 in two locations, washer 116 and washer 148. Filtrate 162 from washer 116 is collected in effluent collection tank 164 where it is discharged from the bleach plant. Likewise, filtrates 166 and 170 from washers 132 and 148 are collected in effluent collection tanks 168 and 172 respectively for discharge from the bleach plant system. In this connection, the consistency of pulp leaving in stream 160 may be about 10 wt. % while the consistency of pulp entering in stream 102 may be from about 25 to about 30 wt. % based on the dry weight of pulp. Accordingly, the amount of fresh make-up water entering at 122 and 158 is balanced with the amount of filtrate leaving at 162, 166 and 170 taking into account the change in the beginning and ending consistency and other factors which affect the net loss or gain in water content of pulp as it traverses the system 100. System 100 therefore represents a process having an initial extraction stage and countercurrent recycling of the filtrate streams.

While the processes illustrated in FIGS. 1 and 2 show only two extraction stages and two bleaching stages, any number of additional extraction and bleaching stages may be used provided a significant portion of the filtrate is recycled and there is an initial alkaline extraction stage $E_O$ $E_{OP}$.

By combining of filtrate recycling and mixing of the filtrate from a later alkaline extraction stage with the filtrate from the first chlorine dioxide stage, significant reduction in chlorinated organics leaving the plant in the effluent may be obtained.

An unexpected advantage of the invention is that a reduction in bleach filtrate volume and reduction in the AOX, COD and color content of the filtrate may be obtained while maintaining a high yield of treated pulp. The yield advantage is obtained because extended cooking and/or oxygen delignification to a Kappa number in the range of 15 to 20 is not necessary with the ECF bleaching sequence of the present invention. Extended delignification is required by totally chlorine free (TCF) bleaching sequences in order to obtain the desired pulp brightness, however, extended delignification is often detrimental to the pulp yield. Accordingly, the reductions in bleach filtrate volume and AOX, color and COD may be obtained according to the invention even when starting with a 30 Kappa number or higher brownstock pulp.

The process of the present invention may be readily adapted to any existing bleach plant. Minor piping changes may also be required to accommodate filtrate recycling, in-situ mixing and treatment of the filtrate streams. However, these changes are not significant and may be accomplished with a minimum of plant disruption and expense.

The following non-limiting examples are provided to further illustrate various aspects of the invention.

EXAMPLE 1

A softwood (southern pine) kraft pulp having a kappa number of 30 was processed according to the bleach process illustrated in FIG. 1. The amount of pulp used for the bleaching runs was 50 grams. The treatment time, temperature, caustic concentration and oxygen pressure are given in Table 1 for the bleach process used. All of the chemical amounts are reported in terms of oven dry pulp weight and all fresh wash water was deionized water. The filtrate properties (AOX, COD, color and MICROTOX toxicity) were monitored during the process along with final pulp brightness and viscosity. Analysis of the pulp and filtrates were performed once the conditions in each stage were substantially unchanging. The final AOX, COD and color concentrations obtained by the process according to the invention were 0.14, 26 and 38 kg/ton respectively for stream 46.

TABLE 1

| Stage | $ClO_2$ (wt. %) | NaOH (wt. %) | $H_2O_2$ (wt. %) | Temp. (° C.) | pH | Consistency (wt. %) | Pressure[2] (psig) | Time (min.) |
|---|---|---|---|---|---|---|---|---|
| $E_{OP}$[1] | — | 2.5 | 0.6 | 80 | 11 | 5 | 50 0 | 60 |
| $D_1$ | 2 | — | — | 50 | 2.5 | 3 | — | 60 |
| $E_{OP}$ | — | 1.75 | 0.6 | 80 | 11 | 11 | 50 0 | 60 |
| $D_2$ | 0.75 | 0.4 | — | 75 | 4 | 10.5 | — | 180 |

[1]0.1 wt. % magnesium added to this stage.

[2]The pressure decreased from 50 psig to 0 psig as oxygen is consumed during the treatment.

Results of pulp bleaching using the treatment sequence with filtrate recycling as illustrated in FIG. 1 and using the conditions of Table 1 yielded a significantly reduced AOX, Color and COD content of the filtrate even after cycling the filtrate streams 35 times with little or no adverse effect on the pulp brightness or viscosity. A comparison of runs made using the foregoing conditions according to the invention are given in Table 2 and the results are compared with filtrate from a bleaching process having no recycle of the filtrate streams.

Results of the runs given in Table 2 demonstrate that recycling according to the invention significantly reduces bleach filtrate volume and the AOX, color and COD content of the filtrate at steady state conditions with improved or at least comparable pulp properties.

Studies were also conducted to determine the effect of various treatment schemes on the pulp and bleach plant effluent. Conditions for the studies are given in Table 3 and the results of the studies are given in Table 4.

| Process | Filtrate (gal/ton) | Filtrate cycle | AOX (kg/ton) | Color (kg/ton) | COD (kg/ton) | Pulp Brightness (GE %) | Pulp Viscosity (cp) |
|---|---|---|---|---|---|---|---|
| $E_{OP}D_1E_{OP}D_2$ no recycle | 106,345 | — | 0.70 | 76 | 87 | 87 | 16 |
| $E_{OP}D_1E_{OP}D_2$ with recycle, mixing and treatment | 5000 | 1 | 0.00 | 16 | 12 | 87 | 17 |
| | | 2 | 0.00 | 22 | 12 | 87 | 17 |
| | | 3 | 0.00 | 24 | 14 | 87 | 15 |
| | | 4 | 0.05 | 26 | 17 | 88 | 16 |
| | | 5 | 0.06 | 28 | 19 | 88 | 16 |
| | | 6 | 0.06 | 28 | 20 | 87 | 16 |
| | | 7 | 0.08 | 26 | 19 | 87 | 16 |
| | | 8 | 0.09 | 26 | 19 | 87.5 | 16 |
| | | 9 | 0.10 | 32 | 20 | 88 | 13 |
| | | 10 | 0.08 | 28 | 20 | 86 | 17 |
| | | 11 | 0.10 | 38 | 20 | 86 | 17 |
| | | 12 | 0.09 | 34 | 24 | 87 | 18 |
| | | 13 | 0.10 | 36 | 26 | 86 | 20 |
| | | 14 | 0.12 | 30 | 22 | 86 | 20 |
| | | 15 | 0.12 | 40 | 22 | 86 | 20 |
| | | 16 | 0.12 | 32 | 20 | 86 | 21 |
| | | 17 | 0.12 | 30 | 20 | 87 | 16 |
| | | 18 | 0.11 | 30 | 20 | 87 | 17 |
| | | 19 | 0.12 | 38 | 20 | 87 | 17 |
| | | 20 | 0.12 | 30 | 20 | 87 | 18 |
| | | 21 | 0.12 | 30 | 20 | 86 | 20 |
| | | 22 | 0.11 | 26 | 20 | 86 | 20 |
| | | 23 | 0.11 | 28 | 16 | 86 | 21 |
| | | 24 | 0.13 | 34 | 19 | 87 | 17 |
| | | 25 | 0.13 | 28 | 20 | 88 | 17 |
| | | 26 | 0.13 | 32 | 22 | 87 | 18 |
| | | 27 | 0.14 | 34 | 22 | 88 | 18 |
| | | 28 | 0.15 | 36 | 22 | 86 | 18 |
| | | 29 | 0.18 | 36 | 28 | — | — |
| | | 30 | 0.15 | 40 | 30 | — | — |
| | | 31 | 0.13 | 40 | 30 | — | — |
| | | 32 | 0.15 | 36 | 30 | — | — |
| | | 33 | 0.14 | 38 | 22 | — | — |
| | | 34 | 0.14 | 38 | 30 | — | — |
| | | 35 | 0.13 | 36 | 26 | — | — |

TABLE 3

| Case Study | Kraft Brownstock Kappa No. | Stage | $O_2$ (lb/ton) | $MgSO_4$ (lb/ton) | $ClO_2$ (lb/ton) | NaOH (lb/ton) | $H_2O_2$ (lb/ton) | Temp. (° C.) | pH | Consistency (wt. %) | Pressure (psig) | Duration (min.) |
|---|---|---|---|---|---|---|---|---|---|---|---|---|
| ECF | 30 | $D_0$ | — | — | 65 | — | — | 50 | 2.5 | 3 | — | 60 |
| Bleaching | | $E_{OP}$ | 10 | — | — | 44 | 12 | 80 | 10.5 | 10 | 50 0 | 60 |
| ($DE_{OP}D$) | | D | — | — | 20 | 6 | — | 75 | 4 | 10 | — | 180 |
| EPA's | 30 | O | 50 | 10 | — | 55 | — | 100 | 11 | 10 | 100 | 60 |
| BAT | | $D_0$ | — | — | 35 | — | — | 50 | 3 | 3 | — | 60 |
| ($ODE_{OP}D$) | | $E_{OP}$ | 10 | — | — | 45 | 12 | 80 | 10.5 | 10 | 50 0 | 60 |
| | | D | — | — | 20 | 8 | — | 75 | 4 | 10 | — | 180 |
| Minimum | 30 | $E_{OP}$ | 30 | 10 | — | 50 | 12 | 80 | 11 | 5 | 50 0 | 60 |
| ECF | | $D_0$ | — | — | 40 | — | — | 50 | 3 | 3 | — | 60 |
| Bleaching[1] | | $E_{OP}$ | 10 | — | — | 40 | 12 | 80 | 10.5 | 10 | 50 0 | 60 |
| $E_{OP}D_1E_{OP}D_2$ | | D | — | — | 20 | 8 | — | 75 | 4 | 10 | — | 180 |
| Bleach Filtrate | 30 | O | 50 | 10 | — | 55 | — | 100 | 11 | 10 | 100 | 60 |
| Recycle[2] | | $D_0$ | — | — | 24.2 | — | — | 54–57 | 3 | 3 | — | 30 |
| ($ODE_{OP}D$) | | $E_{OP}$ | 10 | — | — | 36 | 12 | 88 | 11.5 | 12 | 40 0 | 60 |
| | | D | — | — | 24 | 2.4 | — | 66–77 | 4 | 10 | — | 120–180 |

[1]With the filtrate recycling, mixing, and treatment configuration according to FIG. 1.

[2]With metal and chloride removal processes as reported by Champion International's Laboratory study.

TABLE 4

| | Bleached | Environmental Results (before wastewater treatment) | | | | Pulp Properties | |
|---|---|---|---|---|---|---|---|
| Bleaching Technology | Pulp Yield (%) | Filtrate (gal./ton) | AOX (kg/ton) | COD (kg/ton) | Color (kg/ton) | Brightness (ISO %) | Viscosity (cp) |
| ECF Bleaching $DE_{OP}D$) | 40.0 | 10,000 | 1.1 | 50 | 60 | 87 | 10–20 |
| EPA's BAT ($ODE_{OP}D$) | 39.0 | 10,000 | 0.6 | 30 | 30 | 87 | 15 |
| Minimum ECF Bleaching $E_{OP}D_1E_{OP}D_2$ | 39.5 | 5,000 | 0.18 | 25 | 35 | 87 | 17 |
| Bleach Filtrate Recycle ($ODE_{OP}D$) | 39.0 | 5,000 | 0.1 | 2 | 2 | 86 | 11 |

Additional studies were conducted on unbleached pulp having a Kappa number of 50 in order to compare the process according to the invention with EPA's BAT process and with the ECF bleaching process. Operating conditions and results of the comparative runs are given in Tables 5 and 6 respectively.

TABLE 5

| Case Study | Kraft Brownstock Kappa No. | Stage | $O_2$ (lb/ton) | $MgSO_4$ (lb/ton) | $ClO_2$ (lb/ton) | NaOH (lb/ton) | $H_2O_2$ (lb/ton) | Temp. (° C.) | pH | Consistency (wt. %) | Pressure (psig) | Duration (min.) |
|---|---|---|---|---|---|---|---|---|---|---|---|---|
| ECF | 50 | $D_0$ | — | — | 105 | — | — | 50 | 2.5 | 3 | — | 60 |
| Bleaching | | $E_{OP}$ | 10 | — | — | 160 | 12 | 80 | 10.5 | 10 | 50 0 | 60 |
| ($DE_{OP}D$) | | D | — | — | 25 | 10 | — | 75 | 4 | 10 | — | 180 |
| EPA's | 50 | O | 50 | 10 | — | 75 | — | 100 | 11 | 10 | 100 | 60 |
| BAT | | $D_0$ | — | — | 50 | — | — | 50 | 3 | 3 | — | 60 |
| ($ODE_{OP}D$) | | $E_{OP}$ | 10 | — | — | 45 | 12 | 80 | 10.5 | 10 | 50 0 | 60 |
| | | D | — | — | 20 | 8 | — | 75 | 4 | 10 | — | 180 |
| Minimum | 50 | $E_{OP}$ | 30 | 10 | — | 60 | 12 | 80 | 11 | 5 | 50 0 | 60 |
| ECF | | $D_0$ | — | — | 70 | — | — | 50 | 3 | 3 | — | 60 |
| Bleaching[1] | | $E_{OP}$ | 10 | — | — | 45 | 12 | 80 | 10.5 | 10 | 50 0 | 60 |
| $E_{OP}D_1E_{OP}D_2$ | | D | — | — | 20 | 8 | — | 75 | 4 | 10 | — | 180 |

[1]With filtrate recycling, mixing, and treatment configuration of FIG. 1.

TABLE 6

| Bleaching Technology | Bleached Pulp Yield (%) | Environmental Results (before wastewater treatment) Filtrate (gal./ton) | AOX (kg/ton) | COD (kg/ton) | Color (kg/ton) | Pulp Properties Brightness (ISO %) | Viscosity (cp) |
|---|---|---|---|---|---|---|---|
| ECF Bleaching ($DE_{OP}D$) | 41 | 10,000 | 2.5 | 80 | 90 | 87 | 28 |
| EPA's BAT ($ODE_{OP}D$) | 43 | 10,000 | 1.2 | 45 | 45 | 87 | 25 |
| Minimum ECF Bleaching[1] ($E_{OP}D_0E_{OP}D_1$) | 44 | 5,000 | 0.3 | 40 | 50 | 87 | 25 |

[1]With filtrate recycling, mixing and treatment according to the process illustrated in FIG. 1.

As illustrated in the foregoing Tables 3–6, the process according to the invention (e.g., Minimum ECF Bleaching) gives results comparable to EPA's best available technology (EPA's BAT) with much lower filtrate quantities and much lower capital cost. Operating costs (taking into account the cost of lost yield) for the Minimum ECF Bleaching process are comparable to EPA's BAT. While the color, COD and AOX of the process according to the invention may not be as low as may be obtained by a bleach filtrate recycle process which requires a metal and chloride removal step, operating costs are much lower and capital costs for installing the required equipment are considerably lower than installing and operating the bleach filtrate recycle process. The process according to the invention therefore may achieve the effluent quality required by the EPA's best available technology with a much lower capital expenditure and without the added capital and operating expense of the bleach filtrate recycle process.

EXAMPLE 2

Effluent from a bleaching sequence according to the invention was treated in a biotreatment operation to determine the effect on biotreatability of the effluent. A summary of the biotreatability of the bleach plant effluent is given in Table 7.

TABLE 7

| | Biotreatability Influent | Effluent | Removal (%) |
|---|---|---|---|
| BOD (mg/L) | 300 | 52 | 83 |
| COD (mg/L) | 1364 | 844 | 38 |
| Microtoxicity (15 min., EC 50%) | 92 | >100 | 100 |
| AOX (mg/L) | 9 | 5.6 | 38 |
| Color (mg/L) | 1725 | 1662 | 4 |

The results in the foregoing table demonstrate good biotreatability of the effluent from a bleaching sequence conducted according to the invention. Additional reductions of AOX, color and COD after biotreatment of the effluent provide an overall AOX, color and COD content of the final effluent from the bleach plant of 0.11 kg/ton, 32 kg/ton and 16 kg/ton respectively. These results indicate that bleaching sequences conducted according to the invention are expected to meet proposed EPA guidelines for bleach plant effluent quality.

Although this specification discloses particular embodiments and features of tie invention, it is to be understood that the information provided herein is only for purposes of illustrating known embodiments which the invention may take within the scope of the appended claims, and that other embodiments may exist or may be developed in the future within the scope and spirit of the claims all of which are intended to be covered thereby consistent with the law.

What is claimed is:

1. A method for bleaching a kraft brown stock pulp in a multi-stage elemental chlorine-free bleach sequence which comprises treating the brown stock as the first bleaching stage in the sequence with an initial alkaline extraction stage assisted by oxygen or oxygen and peroxide ($E_O$ or $E_{OP}$) before a first chlorine dioxide stage ($D_1$) in an $E_OD_1E_{OP}D_2$ or $E_{OP}D_1E_{OP}D_2$ bleaching sequence which produces a bleach plant effluent that is not recycled to a recovery boiler, wherein pulp from the $D_1$ and $D_2$ stages is washed after the stages to produce a $D_1$ and $D_2$ stage filtrate containing chlorides and pulp from the initial $E_O$ or initial $E_{OP}$ stage is washed after the stage to produce an initial $E_O$ or initial $E_{OP}$ stage filtrate and wherein at least a portion of the $D_1$ and/or $D_2$ stage filtrate is treated and the consistency of the brown stock entering the initial $E_O$ or initial $E_{OP}$ stage is reduced by recycling the $D_1$ and/or $D_2$ stage filtrate to the initial $E_O$ or initial $E_{OP}$ stage and mixing the recycled $D_1$ and/or $D_2$ stage filtrate with brown stock entering the initial $E_O$ or initial $E_{OP}$ stage so that the treated $D_1$ and/or $D_2$ stage filtrate is incorporated within the initial $E_O$ or initial $E_{OP}$ stage filtrate which in turn is ultimately incorporated into the bleach plant effluent and thereby not recycled to the recovery boiler, whereby the bleach plant effluent has a substantially reduced AOX, COD and color relative to such effluent in the absence of such recycling.

2. The method of claim 1 wherein the consistency of the pulp supplied to the initial $E_O$ or initial $E_{OP}$ stage is in the range of from about 20 to 30% and is reduced as a result of mixing the filtrate from the $D_1$ or $D_2$ stage therewith to a consistency of from about 5 to about 10%.

3. The method of claim 1 wherein the consistency of the pulp supplied to the initial $E_O$ or initial $E_{OP}$ stage is adjusted as a result of mixing the filtrate from the $D_1$ or $D_2$ stage therewith to a consistency in the range of from about 5 to about 10%.

4. The method of claim 3 wherein pulp from the initial $E_O$ or initial $E_{OP}$ stage is washed following the stage with filtrate from the $D_1$ to produce the initial $E_O$ or initial $E_{OP}$ stage filtrate and at least a portion of the initial $E_O$ or initial $E_{OP}$ filtrate is used to adjust the consistency of the pulp entering the wash after the initial $E_O$ or initial $E_{OP}$ stage to a consistency of about 1% prior to washing.

5. The method of claim 1 wherein sufficient NaOH is added to pulp entering the initial $E_O$ or initial $E_{OP}$ stage to provide a pH in the initial $E_O$ or initial $E_{OP}$ of from about 9 to about 11, the initial $E_O$ stage is carried out using oxygen at a temperature in the range of from about 70° to about 90° C. and the initial $E_{OP}$ stage and $E_{OP}$ stage are carried out using oxygen and from about 0.2 to about 2.0 wt. % peroxide based on the oven dry weight of pulp at a temperature in the range of from about 70° to about 90° C.

6. The method of claim 1 wherein the initial stage is an $E_{OP}$ stage containing about from about 0.05 to about 1.5 wt. % peroxide based on the dry weight of pulp.

7. The method of claim 1 wherein the chlorine factor in the $D_1$ stage is maintained in the range of from about 0.05 about 0.35.

8. The method of claim 1 wherein the pulp entering the initial $E_O$ or initial $E_{OP}$ stage has a Kappa number greater than about 25 for softwood and about 15 for hardwood.

9. The method of claim 1 wherein pulp from the $E_{OP}$ stage is washed to provide the $E_{OP}$ stage filtrate at least a portion of which is recycled to a pulp washer for pulp exiting the $D_1$ stage which is washed in the pulp washer to provide $D_1$ stage filtrate containing chlorides and at least a portion of the $D_1$ stage filtrate is recycled to the initial $E_O$ or initial $E_{OP}$ stage for mixing with pulp entering the stage.

10. The method of claim 1 wherein the pulp is delignified from about 10 to about 40% by weight in the initial $E_O$ or initial $E_{OP}$ stage and the pulp following the initial $E_O$ or initial $E_{OP}$ stage is washed to provide the initial $E_O$ or initial $E_{OP}$ stage filtrate at least a portion of which is used to adjust the consistency of the pulp entering the washer subsequent to the initial $E_O$ or initial $E_{OP}$ stage to a consistency of about 1% prior to washing and at least a portion of the remainder is treated as bleach plant effluent.

11. A process for bleaching a kraft brown stock pulp in a multi-stage elemental chlorine-free bleach sequence wherein the pulp has a consistency in the range of from about 25% to about 30% and a pH in the range of from about 3 to about 11 which comprises treating the brown stock pulp as the first bleaching stage in a bleaching sequence with an initial alkaline extraction stage assisted by oxygen or oxygen and peroxide (initial $E_O$ or initial $E_{OP}$ stage) before a first chlorine dioxide stage ($D_1$) in an $E_OD_1E_{OP}D_2$ or $E_{OP}D_1E_{OP}D_2$ bleaching sequence which produces a bleach plant effluent that is not recycled to a recovery boiler, wherein pulp from the first chlorine dioxide stage $D_1$ is washed in a pulp washer to produce a $D_1$ stage filtrate containing chlorides, and pulp from the initial $E_O$ or initial $E_{OP}$ stage is washed after the stage to produce an initial $E_O$ or initial $E_{OP}$ stage filtrate, and at least a portion of the $D_1$ stage filtrate is treated and the consistency of the brown stock entering the initial $E_O$ or initial $E_{OP}$ stage is reduced by recycling the $D_1$ stage filtrate to the initial $E_O$ or $E_{OP}$ stage and mixing the $D_1$ stage filtrate with brown stock entering the initial $E_O$ or initial $E_{OP}$ stage so that the treated $D_1$ stage filtrate is incorporated with the initial $E_O$ or initial $E_{OP}$ stage filtrate which is in turn incorporated within the bleach plant effluent and thereby not recycled to the recovery boiler, substantially all filtrates from later bleaching and extraction stages being recycled to earlier stages of the bleaching sequence and ultimately incorporated with the bleach plant effluent and thereby not recycled to the recovery boiler.

12. The process of claim 11 wherein the consistency of the pulp exiting the first $E_O$ or $E_{OP}$ stage is reduced to within the range of from about 5 to about 10% by weight based on the dry weight of pulp by mixing filtrate from the initial chlorine dioxide stage therewith.

13. The process of claim 12 wherein the consistency of the pulp in the initial $E_O$ or $E_{OP}$ stage is in the range of from about 5 to about 10 wt. % after mixing the entering pulp with the initial chlorine dioxide stage filtrate.

14. The process of claim 11 wherein the pulp has a temperature in the range of from about 70° C. to about 90° C. and a pH of from about 9 to about 11 in the initial $E_O$ and initial $E_{OP}$ stages, the initial $E_O$ stage is carried out using oxygen and the initial $E_{OP}$ and $E_{OP}$ stages are carried out using oxygen and from about 0.2 to about 2.0 wt. % peroxide based on the oven dry weight of pulp.

15. The process of claim 11 wherein the initial stage is an $E_{OP}$ stage containing about from about 0.05 to about 1.5 wt. % peroxide based on the dry weight of pulp.

16. The process of claim 11 wherein the chlorine factor in the $D_0$ stage is maintained in the range of from about 0.05 to about 0.35.

17. The process of claim 11 wherein prior to the bleaching sequence, the pulp entering the initial $E_O$ or initial $E_{OP}$ stage has a Kappa number greater than about 25 for softwood and greater than about 15 for hardwood.

18. The process of claim 11 wherein pulp from the $E_{OP}$ stage is washed to provide the $E_{OP}$ stage filtrate at least a portion of which is recycled to a pulp washer for the $D_1$ stage for washing pulp after the $D_1$ stage to provide the $D_1$ stage filtrate containing chlorides and at least a portion of the $D_1$ stage filtrate is recycled to the initial $E_O$ or initial $E_{OP}$ stage and mixed with pulp entering the stage.

19. The process of claim 11 wherein the pulp is delignified from about 10 to about 40% by weight in the initial $E_O$ or initial $E_{OP}$ stage and the pulp following the initial $E_O$ or initial $E_{OP}$ stage is washed to provide the initial $E_O$ or initial $E_{OP}$ stage filtrate at least a portion of which is used to adjust the consistency of the pulp entering the washer subsequent to the initial $E_O$ or initial $E_{OP}$ stage to a consistency of about 1% prior to washing and at least a portion of the remainder is treated as bleach plant effluent.

20. A pulp bleaching process for reducing total bleach plant effluent volume which comprises treating a kraft brown stock pulp having a consistency of from about 20 to about 30% by weight and a Kappa number greater than about 25 for softwood and greater than about 15 for hardwood as the first bleaching stage of an elemental chlorine-free bleaching bleach sequence in an initial alkaline extraction stage assisted by oxygen or oxygen and peroxide (initial $E_O$ or initial $E_{OP}$ stage) before a first chlorine dioxide stage ($D_1$) in an $E_OD_1E_{OP}D_2$ or $E_{OP}D_1E_{OP}D_2$ bleaching sequence which produces a bleach plant effluent that is not recycled to a recovery boiler, wherein pulp is washed after the $D_1$ stage, after the $D_2$ stage, and after the $E_{OP}$ stage to provide filtrates, at least a portion of filtrate from the $D_2$ stage contains chlorides and is recycled to a washer for the $E_{OP}$ stage for washing pulp after the $E_{OP}$ stage to produce an $E_{OP}$ stage filtrate, at least a portion of the $E_{OP}$ stage filtrate is recycled to the $D_1$ stage for washing pulp after the $D_1$ stage to produce a $D_1$ stage filtrate containing chlorides, and at least a portion of the $D_1$ stage filtrate is recycled to brown stock entering the initial $E_O$ or initial $E_{OP}$ stage and mixed with the brown stock to adjust the consistency of the brown stock entering the initial $E_O$ or initial $E_{OP}$ stage to from about 5 to about 10 wt. % and to effect treatment of the $D_1$ stage filtrate, and wherein pulp is washed after the initial $E_O$ or initial $E_{OP}$ stage to produce an initial $E_O$ or initial $E_{OP}$ stage filtrate containing chlorides from at least the $D_1$ stage filtrate mixed with brown stock entering the initial $E_O$ or initial $E_{OP}$ stage, the filtrate of which is in turn ultimately incorporated within the bleach plant effluent and thereby not recycled to recovery boilers.

21. The process of claim 20 wherein the pulp has a temperature in the range of from about 70° C. to about 90°

C. and a pH of from about 9 to about 11 in the initial $E_O$ and initial $E_{OP}$ stages, the initial $E_O$ stage is carried out using oxygen and the initial $E_{OP}$ and $E_{OP}$ stages are carried out using oxygen and from about 0.2 to about 2.0 wt. % peroxide based on the oven dry weight of pulp.

22. The process of claim 20 wherein the initial stage is an $E_{OP}$ stage containing about from about 0.2 to about 2.0 wt. % peroxide based on the dry weight of pulp.

23. The process of claim 20 wherein the chlorine factor in the $D_0$ stage is maintained in the range of from about 0.05 to about 0.35.

24. The process of claim 20 wherein the pulp is delignified from about 10 to about 40% by weight in the first $E_O$ or $E_{OP}$ stage.

* * * * *

UNITED STATES PATENT AND TRADEMARK OFFICE

CERTIFICATE OF CORRECTION

PATENT NO. : 6,569,284 B1
DATED : May 27, 2003
INVENTOR(S) : Caifang Yin et al.

It is certified that error appears in the above-identified patent and that said Letters Patent is hereby corrected as shown below:

Column 2,
Lines 21 and 22, after "produce a" delete "$D_o$ or D filtrate and the $D_o$ or D filtrate" and insert therefor -- $D_1$ or $D_2$ filtrate and the $D_1$ and $D_2$ filtrate --

Column 3,
Line 17, after "initial" delete "$E_o$ or $E_{op}$" and insert therefor -- $E_{op}$ or $E_o$ --

Column 5,
Line 62, after "from" delete "tile" and insert therefor -- the --

Column 13,
Line 67, after "features of" delete "tie" and insert therefor -- the --
Table 6, first row under "Bleaching Technology" delete "($E_{op}D_oE_{op}D_1$)" and insert therefor -- $E_{op}D_1E_{op}D_2$ --

Column 14,
Line 61, after "$D_1$" and before "to" insert -- stage --

Column 16,
Line 13, after "factor in the" delete "$D_o$" and insert therefor -- $D_1$ --

Column 18,
Line 2, after "factor in the" delete "$D_o$" and insert therefore -- $D_1$ --
Line 5, after "weight" delete "in the first $E_o$ or $E_{op}$ stage" and insert therefor -- in the initial $E_o$ or initial $E_{op}$ stage --

Signed and Sealed this

Second Day of March, 2004

JON W. DUDAS
*Acting Director of the United States Patent and Trademark Office*